United States Patent [19]

Karabakakis

[11] Patent Number: 4,647,120

[45] Date of Patent: Mar. 3, 1987

[54] ELECTRICAL SAFETY PLUG CONNECTION

[76] Inventor: Stelios Karabakakis, P. Kalliga 21-33, Athen 114-73, Greece

[21] Appl. No.: 699,656

[22] Filed: Feb. 8, 1985

[30] Foreign Application Priority Data

Feb. 8, 1984 [GR] Greece ..... 73756
Aug. 29, 1984 [GR] Greece ..... 80240

[51] Int. Cl.[4] ..... H01R 11/30
[52] U.S. Cl. ..... 339/12 R; 200/51.09
[58] Field of Search ..... 339/12 R, 12 G, 111, 339/75 M, 222; 200/51.09, 51.07

[56] References Cited

U.S. PATENT DOCUMENTS

| | | | |
|---|---|---|---|
| 2,955,239 | 10/1960 | Rouse | 339/12 R |
| 3,521,216 | 7/1970 | Tolegain | 339/12 R |
| 3,868,160 | 2/1975 | Kersman | 200/51.09 |
| 4,159,858 | 7/1979 | Toraya | 339/12 R |
| 4,317,969 | 3/1982 | Riegler et al. | 339/12 R |
| 4,451,113 | 5/1984 | Zuniga | 339/12 R |

*Primary Examiner*—Gil Weidenfeld
*Assistant Examiner*—Thomas M. Kline
*Attorney, Agent, or Firm*—Remy J. VanOphem

[57] ABSTRACT

An electrical safety plug connection in which the part of the power outlet accessible from the outside becomes separated from the source of power when the plug is pulled out. The power outlet has two chambers one above the other, the lower chamber being a self-contained chamber which contains the live contacts and which is separated by an insulating partition from a receiving chamber thereabove which receives the plug. Bridging contacts are arranged in the insulating partition, and the bridging contacts extend from the lower chamber into the receiving chamber. In the closed chamber there is a magnetic body which usually rests on the bottom of the chamber but is freely movable in the upward direction. This magnetic body has connecting elements which connect the contacts to the source of power and the bridging contacts when the magnetic body is in an elevated position, but do not connect them when it is in its lower position, and it is caused to move to its elevated position only when the plug has been inserted in the upper chamber by a magnet carried by the plug.

29 Claims, 10 Drawing Figures

ELECTRICAL SAFETY PLUG CONNECTION

BACKGROUND OF THE INVENTION

1. Field of the Invention

The present invention relates to an electrical safety plug connection, the connection including a plug which is connected to the line that leads to a consuming device, and a power outlet that is connected to a source of power.

2. Description of the Prior Art

The so-called "safety outlets" (grounded contact-type outlets) do not insure that an unauthorized or inexperienced person will be unable to reach into the outlet directly or with metallic elements, and thereby permit a conductive connection to be made between the source of power and the person involved, which creates a risk of a serious injury, and possibly a fatal injury, to such person.

SUMMARY OF THE INVENTION

The present invention is directed to the problem of providing an electrical safety plug connection which absolutely guarantees that when the plug is pulled out every part of the outlet accessible from the outside is currentless, i.e., separated from the source of power.

The problem to which this invention is directed is solved by the following features: the power outlet has two chambers, one above the other. The lower chamber is a closed, self-contained chamber which has contacts leading to the source of power and which is separated by an insulating partition from the upper receiving chamber thereabove. The receiving chamber is adapted to receive the plug. Bridging contacts are positioned in the insulating partition. A movable magnetic body is positioned in the lower chamber and usually rests on the bottom of the lower chamber, but is freely movable in the upward direction in the lower chamber. The movable magnetic body has connecting elements which, when the movable magnetic body is in its upper position, connect the contacts in the lower chamber to the bridging contacts. The movable magnetic body does not connect these elements when it is in its lower position, however. The part of the plug which is inserted into the upper receiving chamber of the power outlet includes contacting points which are capable of making contact with the ends of the bridging contacts that extend into the upper chamber, and a magnetic component which, when the plug is inserted into the upper receiving chamber, attracts the movable magnetic body in the upward direction in the closed, lower chamber, thereby connecting the contacts in the closed, lower chamber, the bridging contacts in the partition between the two chambers, and the contacting points in the plug, to thereby conduct electrical energy to the consuming device.

Since the movable magnetic body which carries connecting elements in the self-contained lower chamber does not have any connection whatsoever to the upper receiving chamber, when the plug is pulled out, it is not dangerous to reach into the upper chamber because no lines lead into it from the power source. Thus, absolute safety is guaranteed for the power outlet and, thus, for the entire plug connection. The flow of current from the power outlet to the consuming device is established automatically when the plug is inserted into the upper chamber, without requiring anyone to touch the contacts, because the latter are housed in such a way that the attraction of the magnetic body in the self-contained chamber takes place only after the plug is completely inserted into the power outlet located thereabove.

To make absolutely certain that the magnetic body with the contacts located theron actually falls down after the plug is pulled out, in the preferred embodiment of the invention an auxiliary magnet is provided below the closed chamber. This auxiliary magnet guarantees that the movable magnetic body is reliably returned to the bottom of the lower chamber after the plug is pulled out of the upper receiving chamber.

The magnetic body in the closed, lower chamber may, of course, consist of a plurality of individual magnetic bodies each containing one of the corresponding contacts. The plug may be an appropriately insulated, completely magnetic plug on which appropriate contact strips or wafers are arranged to make contact with the bridging contacts when the plug is inserted. It may also be a plug having prongs which are arranged on an appropriate magnetic body, the prongs possibly penetrating into the plug through an insulator. The plug prongs may also be designed as magnets themselves. It is unimportant whether the movable magnetic body in the closed chamber is actually a magnet. It may also be a soft iron part arranged between the magnet of the plug and the auxiliary magnet, in which case the magnetic force of the magnets must, of course, be such that this part is attracted in the direction of the plug when the plug is inserted. The movable magnetic body may also be a relatively weak magnet, it possibly being sufficient that the plug contain an appropriate part which causes the magnetic part to be drawn upward when the plug is inserted. The auxiliary magnet might then possibly be only a soft-iron part as well which insures that the magnetic part is drawn downward in the closed chamber making the power outlet safe when the plug is pulled out.

DETAILED DESCRIPTION OF THE PREFERRED EMBODIMENT

Figure 1:
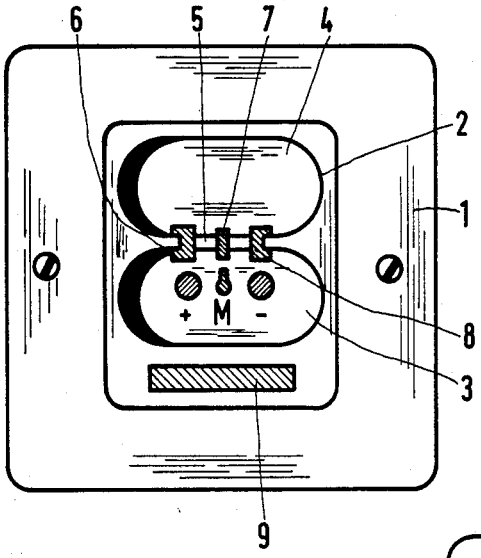
FIG. 1 is a front view of the large plate of a power outlet.

An electrical outlet plate 1 has an opening 2 that permits access to an electrical safety plug connection. A chamber 3 is positioned in the opening 2. After final assembly of the plug connection, the chamber 3 will be sealed and inaccessible from the outside, and is, therefore, self-contained. The chamber 3 has positive (+) and negative (−) contacts that lead to the source of power, and a ground contact (M) that leads to a ground line. Above the chamber 3 there is a receiving chamber 4 separated from the chamber 3 by a partition 5 in which bridging contacts 6, 7 and 8 are arranged. A magnet 9 is provided below the chamber 3 for purposes which will subsequently be fully described. In the illustrated embodiment a supply of current is available by connection to the positive (+) and negative (−) contacts protected by the ground line. The principle of the invention is, of course, not limited in this respect; any type and number of appropriate leads are basically conceivable, and the invention may be designed for use in alternating or direct current circuits.

Figure 2:
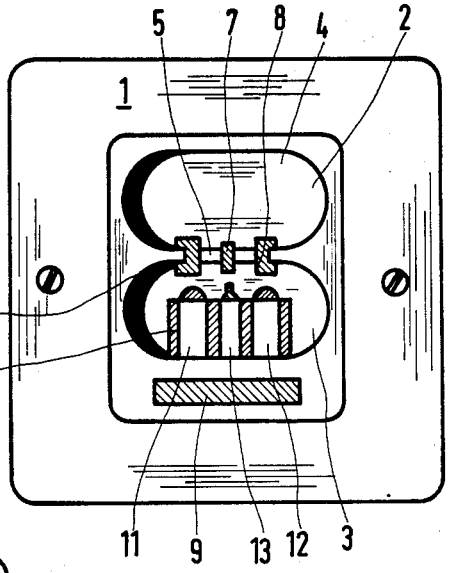
FIG. 2 is a view similar to FIG. 1, but with a magnetic body inserted in the lower chamber, which is subsequently tightly closed.

As is shown in FIG. 2, the chamber 3, which is completely closed after final assembly, contains a vertically movable magnetic body 10 in which contacts 11, 12 and 13 are provided. The contacts 11, 12 and 13 are insulated in an appropriate manner. The positive (+), negative (−), and (M) contacts can also be identified in FIG. 2, although they are partially obscured by the magnetic body.

Figure 3:
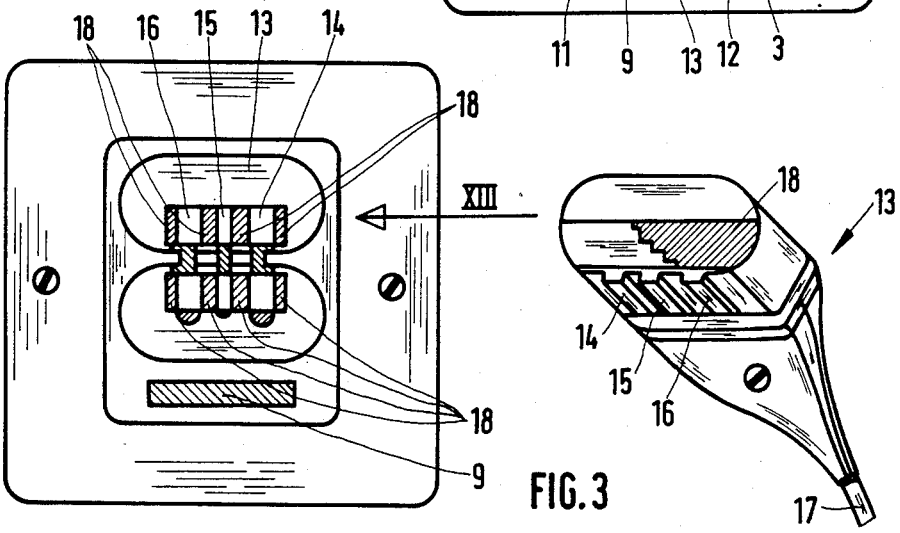
FIG. 3 is a view similar to FIG. 2 but with a plug inserted in the upper receiving chamber, from the position shown in perspective at the side for the sake of clarity.
Figure 2A:
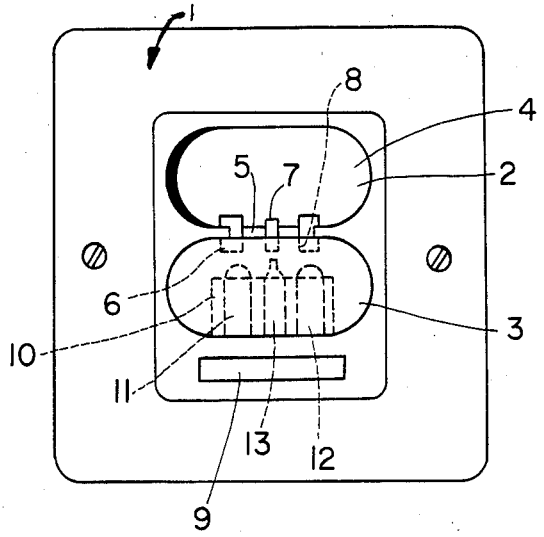
FIG. 2A is a view similar to FIG. 2 in which the lower chamber is shown in its tightly closed condition.

FIG. 3 shows the arrangement of FIG. 2 after a plug 13 is inserted into the receiving chamber 4 in the direction of arrow XIII from its initial position shown at the side in perspective. The plug 13 has contacts 14, 15 and 16 which are connected with wires or stranded conductors contained in an insulated cable 17. The insulated cable 17 is connected to the consuming device, for example a lamp (not shown). The plug 13 also contains a magnetic component 18 which, when the plug 13 is inserted completely into the receiving chamber 4 (FIGS. 1 and 2), causes the magnetic body 10 to be attracted upward. The upward movement of the movable magnetic body 10 serves to connect the positive (+), negative (−) and ground contacts (M) in the lower chamber 3 to the contacts 14, 15 and 16 in the receiving chamber 4, respectively, via the bridging contacts 6, 7 and 8, thereby permitting current to flow to the consuming device via the plug 13 and the cable.

When the plug 13 is pulled out, the magnetic connection between the magnetic component 18 and the magnetic body 10 is interrupted and the magnetic body 10 drops to the bottom of the chamber 3, under the influence of the force from the auxiliary magnet 9. After the plug 13 has been pulled out there is no part of the power outlet accessible from the outside which is connected electrically to the source of power, and the power outlet is, therefore, a safe one.

Figure 4A:
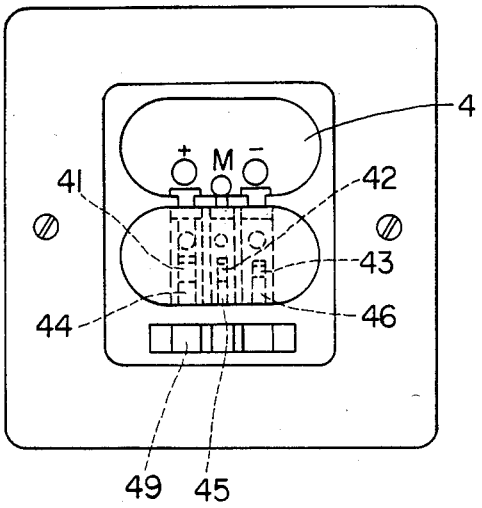
FIG. 4A is a view similar to FIG. 4 in which the lower chamber is shown in its tightly closed condition.
Figure 4:
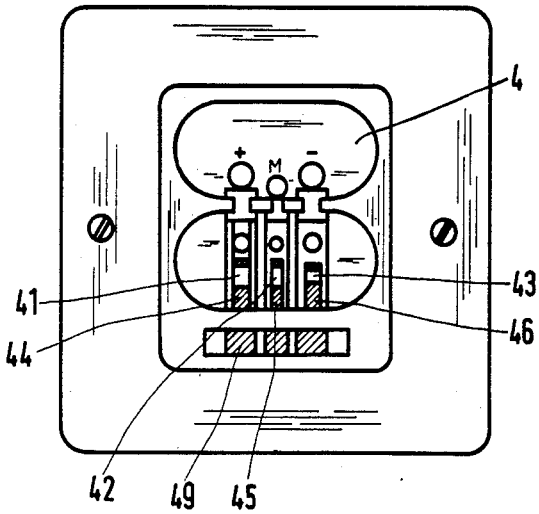
FIG. 4 is a view similar to FIG. 2 of an alternative embodiment of the present invention.

In the embodiment illustrated in FIG. 4, there are individual contacts 41, 42, 43 which are separated from each other. The contacts 41, 42 and 43 are provided with magnets 44, 45, 46, respectively, positioned in vertically extending grooves so that when a plug 47 is inserted into the receiving chamber 4 the attraction of these individual contacts again takes place, thereby closing the circuit to the consuming device. An auxiliary magnet 49 may be designed as a multi-part magnet, as indicated in the drawing.

Figure 5:
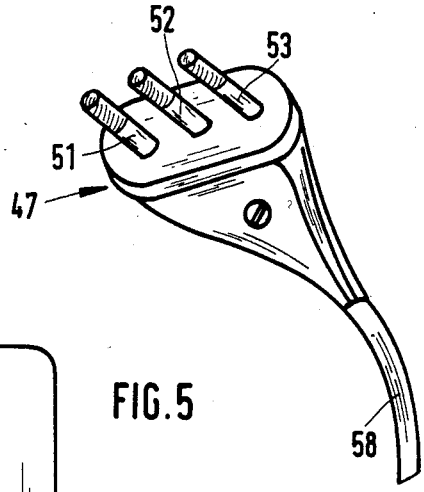
FIG. 5 is a view similar to FIG. 3 of the alternative embodiment of FIG. 2.
Figure 5:
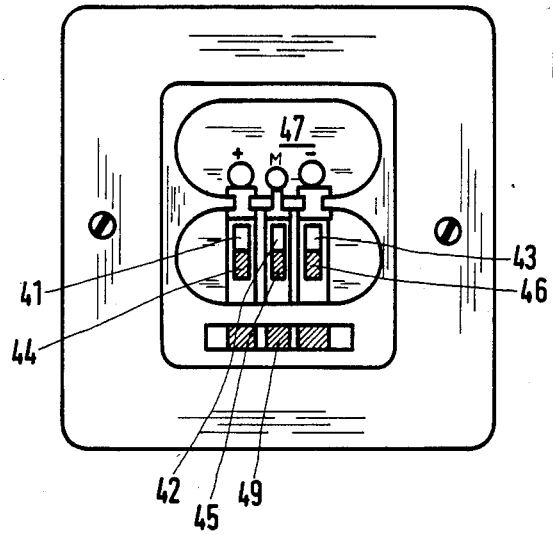

The plug 47, to be used with the embodiment of FIG. 4, is illustrated in FIG. 5, and is provided with three magnetic plug prongs 51, 52, 53 which are inserted into the corresponding positive (+), negative (−) and ground contacts (M) so that after the corresponding individual magnets 44, 45, 46 are raised, contact is established via the plug 47 and its cable 58, between the consuming device, and the lines connected to the positive (+), negative (−) and ground contacts (M).

Figure 6:
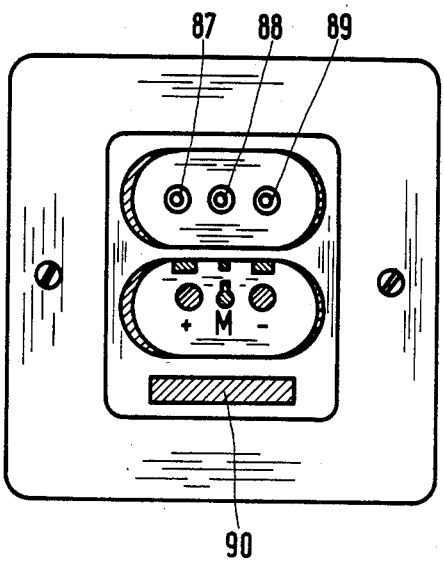
FIG. 6 is a view similar to FIG. 1 of yet another alternative embodiment of the present invention.
Figure 7:
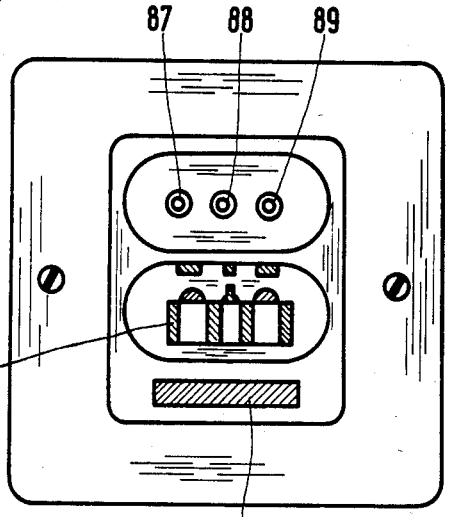
FIG. 7 is a view similar to FIG. 2 of the alternative embodiment of FIG. 6.
Figure 8:
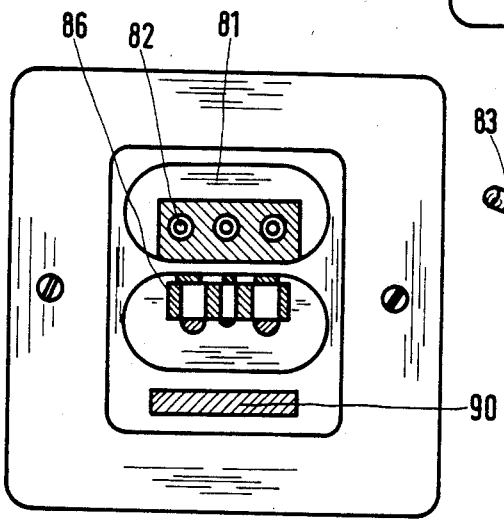
FIG. 8 is a view similar to FIG. 5 of the alternative embodiment of FIGS. 6 and 7.
Figure 8:
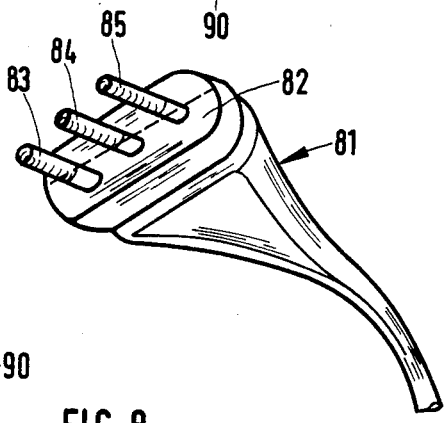

In the embodiment illustrated in FIGS. 6 through 8, there is an arrangement of individual chambers which is the same as the arrangement in the embodiment of FIGS. 1 through 3 and the embodiment of FIGS. 4 and 5. The embodiment of FIGS. 6 through 8 differs in that a magnetic element 82 is provided on a plug 81 according to FIG. 8, the magnetic element 82 being insulated from the individual plug prongs 83, 84, 85. When the plug 81 with its magnetic element 82 is inserted into the upper receiving chamber 4, the magnetic element 82 acts upon a movable magnetic body 86, and causes it to make a connection between the plug prongs 83, 84, 85, after insertion in openings 87, 88, 89 and the contacts in the lower chamber. An auxiliary magnet 90 is also provided in this case. The connections leading to the openings 87, 88, 89, or rather their metallic bottoms or metallic linings, are located behind the plane of the drawing figures and are, therefore, not visible.

Having thus described the present invention by way of an exemplary embodiment, it will be apparent to those skilled in the art that many modifications may be made from the exemplary embodiment without departing from the spirit of the present invention or the scope of the claims appended thereto.

What is claimed is:

1. An electrical safety plug connection comprising:

a plug which is adapted to be connected to a line that leads to an electricity consuming device, said plug having contacts and a magnet; and a power outlet, said power outlet comprising:

a first chamber, said first chamber being closed and substantially inaccessible from the outside thereof;

a second chamber positioned above said first chamber, said second chamber being open and being accessible to and adapted to receive said plug;

contacts leading to a source of power, said contacts being located in said first chamber;

an insulating partition separating said first chamber and said second chamber;

bridging contacts carried by said insulating partition, said bridging contacts extending from said first chamber into said second chamber and being adapted to contact said contacts of said plug when said plug is inserted in said second chamber;

vertically movable magnetic means positioned within said first chamber, said vertically movable magnetic means normally being at a first lower position in said first chamber and having contacts which are adapted to connect said contacts leading to the source of power to said bridging contacts when said vertically movable magnetic means is above said first lower position in said first chamber, said contacts further being adapted to disconnect said contacts leading to said source of power and said bridging contacts when said vertically movable magnetic means is at said first lower position in said first chamber; and said magnet of said plug being adapted, when said plug is inserted in said second chamber, to cause said vertically movable magnetic means to rise within said first chamber to a second higher position to make contact with said bridging contacts and thereby with said contacts of said plug.

2. The electrical safety plug connection according to claim 1 further comprising:

an auxiliary magnet positioned below said vertically movable magnetic means, said auxiliary magnet serving to attract said vertically movable magnetic means to said first lower position in said first chamber to assist in the return of said vertically movable magnetic means to said first lower position in said first chamber when said plug has been removed from said second chamber.

3. The electrical safety plug connection according to claim 2 wherein said auxiliary magnet is positioned below said first chamber, said first lower position of said vertically movable magnetic means in said first chamber being at the bottom of said first chamber.

4. The electrical safety plug connection according to claim 1 wherein said vertically movable magnetic means comprises a single vertically movable magnet, said single vertically movable magnet having all of said contacts of said vertically movable magnetic means.

5. The electrical safety plug connection according to claim 2 wherein said vertically movable magnetic means comprises a single vertically movable magnet, said single vertically movable magnet having all of said contacts of said vertically movable magnetic means.

6. The electrical safety plug connection according to claim 3 wherein said vertically movable magnetic means comprises a single vertically movable magnet, said single vertically movable magnet having all of said contacts of said vertically movable magnetic means.

7. The electrical safety plug connection according to claim 1 wherein said vertically movable magnetic means comprises a plurality of separately vertically movable magnets, each of said separately vertically movable magnets having one of said contacts of said vertically movable magnetic means.

8. The electrical safety plug connection according to claim 2 wherein said vertically movable magnetic means comprises a plurality of separately vertically movable magnets, each of said separately vertically movable magnets having one of said contacts of said vertically movable magnetic means.

9. The electrical safety plug connection according to claim 3 wherein said vertically movable magnetic means comprises a plurality of separately vertically movable magnets, each of said separately vertically movable magnets having one of said contacts of said vertically movable magnetic means.

10. The electrical safety plug connection according to claim 1 wherein said contacts of said plug comprise a plurality of prongs, said prongs extending through said magnet of said plug.

11. The electrical safety plug connection according to claim 2 wherein said contacts of said plug comprise a plurality of prongs, said prongs extending through said magnet of said plug.

12. The electrical safety plug connection according to claim 4 wherein said contacts of said plug comprise a plurality of prongs, said prongs extending through said magnet of said plug.

13. The electrical safety plug connection according to claim 5 wherein said contacts of said plug comprise a plurality of prongs, said prongs extending through said magnet of said plug.

14. The electrical safety plug connection according to claim 6 wherein said contacts of said plug comprise a plurality of prongs, said prongs extending through said magnet of said plug.

15. The electrical safety plug connection according to claim 7 wherein said contacts of said plug comprise a plurality of prongs, said prongs extending through said magnet of said plug.

16. The electrical safety plug connection according to claim 8 wherein said contacts of said plug comprise a plurality of prongs, said prongs extending through said magnet of said plug.

17. The electrical safety plug connection according to claim 9 wherein said contacts of said plug comprise a plurality of prongs, said prongs extending through said magnet of said plug.

18. An electrical safety plug connection comprising:

a plug which is adapted to be connected to a line that leads to an electricity consuming device, said plug having magnetic contacts; and a power outlet, said power outlet comprising:

a first chamber, said first chamber being closed and substantially inaccessible from the outside thereof;

a second chamber positioned above said first chamber, said second chamber being open and being accessible to and adapted to receive said plug;

contacts leading to a source of power, said contacts being located in said first chamber;

an insulating partition separating said first chamber and said second chamber;

bridging contacts carried by said insulating partition, said bridging contacts extending from said first chamber into said second chamber and being adapted to contact said contacts of said plug when said plug is inserted in said second chamber;

vertically movable magnetic means positioned within said first chamber, said vertically movable magnetic means normally being at a first lower position in said first chamber and having contacts which are adapted to connect said contacts leading to said source of power to said bridging contacts when said vertically movable magnetic means is above said first lower position in said first chamber, said contacts further being adapted to disconnect said contacts leading to said source of power and said bridging contacts when said vertically movable magnetic means is at said first lower position in said first chamber; and said magnetic contacts of said plug being adapted, when said plug is inserted in said second chamber, to cause said vertically movable magnetic means to rise within said first chamber to a second higher position to make contact with said bridging contacts and thereby with said contacts of said plug.

19. The electrical safety plug connection according to claim 18 wherein said magnetic contacts of said plug comprise a plurality of magnetic prongs.

20. The electrical safety plug connection according to claim 18 further comprising:

an auxiliary magnet positioned below said vertically movable magnetic means, said auxiliary magnet serving to attract said vertically movable magnetic means to said first lower position in said first chamber to assist in the return of said vertically movable magnetic means to said first lower position in said first chamber when said plug has been removed from said second chamber.

21. The electrical safety plug connection according to claim 19 wherein said auxiliary magnet is positioned below said first chamber, said first lower position of said vertically movable magnetic means in said first chamber being at the bottom of said first chamber.

22. The electrical safety plug connection according to claim 18 wherein said vertically movable magnetic means comprises a single vertically movable magnet, said single vertically movable magnet having all of said contacts of said vertically movable magnetic means.

23. The electrical safety plug connection according to claim 19 wherein said vertically movable magnetic means comprises a single vertically movable magnet, said single vertically movable magnet having all of said contacts of said vertically movable magnetic means.

24. The electrical safety plug connection according to claim 20 wherein said vertically movable magnetic means comprises a single vertically movable magnet, said single vertically movable magnet having all of said contacts of said vertically movable magnetic means.

25. The electrical safety plug connection according to claim 21 wherein said vertically movable magnetic means comprises a single vertically movable magnet, said single vertically movable magnet having all of said contacts of said vertically movable magnetic means.

26. The electrical safety plug connection according to claim 18 wherein said vertically movable magnetic means comprises a plurality of separately vertically movable magnets, each of said separately vertically movable magnets having one of said contacts of said vertically movable magnetic means.

27. The electrical safety plug connection according to claim 19 wherein said vertically movable magnetic means comprises a plurality of separately vertically movable magnets, each of said separately vertically movable magnets having one of said contacts of said vertically movable magnetic means.

28. The electrical safety plug connection according to claim 20 wherein said vertically movable magnetic means comprises a plurality of separately vertically movable magnets, each of said separately vertically movable magnets having one of said contacts of said vertically movable magnetic means.

29. The electrical safety plug connection according to claim 21 wherein said vertically movable magnetic means comprises a plurality of separately vertically movable magnets, each of said separately vertically movable magnets having one of said contacts of said vertically movable magnetic means.

* * * * *

UNITED STATES PATENT AND TRADEMARK OFFICE

CERTIFICATE OF CORRECTION

PATENT NO. : 4,647,120

DATED : March 3, 1987

INVENTOR(S) : Stelios Karabakakis

It is certified that error appears in the above-identified patent and that said Letters Patent is hereby corrected as shown below:

In the Claims

Column 7, line 12, delete "19" and insert ---- 20 ----.

Signed and Sealed this

Thirteenth Day of October, 1987

*Attest:*

DONALD J. QUIGG

*Attesting Officer*

*Commissioner of Patents and Trademarks*